US009485585B2

(12) United States Patent
McCratic et al.

(10) Patent No.: US 9,485,585 B2
(45) Date of Patent: Nov. 1, 2016

(54) SHOCK RESISTANT COIL AND RECEIVER

(71) Applicant: Knowles Electronics, LLC, Itasca, IL (US)

(72) Inventors: Michael McCratic, Cary, IL (US); Matthew Mason, Algonquin, IL (US); Ryan Grounds, Lake In The Hills, IL (US); Dennis R. Kirchhoefer, Plainfield, IL (US); Thomas E. Miller, Arlington Heights, IL (US); Henry G. Nepomuceno, Elk Grove Village, IL (US); Shehab Albahri, Hanover Park, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 14/509,542

(22) Filed: Oct. 8, 2014

(65) Prior Publication Data

US 2015/0110338 A1 Apr. 23, 2015

Related U.S. Application Data

(60) Provisional application No. 61/892,112, filed on Oct. 17, 2013, provisional application No. 61/945,968, filed on Feb. 28, 2014.

(51) Int. Cl.
*H04R 11/02* (2006.01)
*H04R 9/02* (2006.01)
(Continued)

(52) U.S. Cl.
CPC ..... *H04R 9/025* (2013.01); *H04R 11/00* (2013.01); *H04R 11/06* (2013.01); *H04R 25/604* (2013.01); *H04R 11/02* (2013.01); *H04R 2209/024* (2013.01)

(58) Field of Classification Search
CPC ..... H04R 11/00; H04R 11/02; H04R 11/04; H04R 25/00; H04R 31/00; H04R 2209/024; H04R 1/08; H04R 9/025; H04R 11/06; H04R 25/604
USPC ..... 381/96, 412, 414, 417, 418, 322, 324, 381/396, 355, 369; 29/594; 335/302, 252
See application file for complete search history.

(56) References Cited

U.S. PATENT DOCUMENTS 3,588,383 A * 6/1971 Carlson ..... H04R 11/00 381/386
3,935,398 A 1/1976 Carlson
(Continued)

FOREIGN PATENT DOCUMENTS

CN 203840067 9/2014
CN 203840177 9/2014
(Continued)

OTHER PUBLICATIONS

International Search Report and Written Opinion for PCT/US2014/059888 dated Dec. 24, 2014 (9 pages).

*Primary Examiner* — Huyen D Le
(74) *Attorney, Agent, or Firm* — Fitch, Even, Tabin & Flannery LLP

(57) ABSTRACT

A motor includes an armature, a coil, and a magnetic support structure. The motor also includes at least one magnet that defines a space. The coil forms a tunnel. The space is defined by the at least one magnet being aligned with the tunnel formed by the coil. Portions of the armature extend through the space and the tunnel. An opening at an end of the coil is shaped so as to restrict movement of the armature.

18 Claims, 9 Drawing Sheets

(51) Int. Cl.

| | |
|---|---|
| ***H04R 11/00*** | (2006.01) |
| ***H04R 11/06*** | (2006.01) |
| ***H04R 25/00*** | (2006.01) |

(56) References Cited

U.S. PATENT DOCUMENTS

| | | | | |
|---|---|---|---|---|
| 4,272,654 | A * | 6/1981 | Carlson | 310/20 |
| 4,473,722 | A | 9/1984 | Wilton | |
| 5,101,435 | A | 3/1992 | Carlson | |
| 5,222,050 | A * | 6/1993 | Marren | H04R 11/00 181/132 |
| 5,610,989 | A | 3/1997 | Salvage | |
| 5,647,013 | A * | 7/1997 | Salvage et al. | 381/396 |
| 5,708,721 | A | 1/1998 | Salvage | |
| 6,041,131 | A | 3/2000 | Kirchhoefer | |
| 6,075,870 | A | 6/2000 | Geschiere et al. | |
| 6,654,477 | B1 | 11/2003 | Miller | |
| 6,658,134 | B1 | 12/2003 | Van Hal et al. | |
| 7,050,602 | B2 | 5/2006 | Miller | |
| 7,103,196 | B2 | 9/2006 | Warren | |
| 7,164,776 | B2 | 1/2007 | Miller | |
| 7,203,334 | B2 | 4/2007 | Schafer | |
| 7,236,609 | B1 * | 6/2007 | Tsangaris et al. | 381/417 |
| 7,336,797 | B2 | 2/2008 | Thompson | |
| 7,362,878 | B2 | 4/2008 | Miller | |
| 7,366,317 | B2 | 4/2008 | Miller | |
| 7,415,125 | B2 | 8/2008 | Warren | |
| 7,443,997 | B2 | 10/2008 | Miller | |
| 7,817,815 | B2 | 10/2010 | Miller | |
| 7,860,264 | B2 | 12/2010 | Jiles | |
| 7,921,540 | B2 | 4/2011 | Jiles | |
| 7,925,041 | B2 | 4/2011 | Jiles | |
| 7,995,789 | B2 | 8/2011 | Tsangaris | |
| 8,027,492 | B2 | 9/2011 | Miller | |
| 8,233,646 | B2 | 7/2012 | Lutz | |
| 8,494,209 | B2 | 7/2013 | Miller | |
| 8,824,726 | B2 | 9/2014 | Miller | |
| 8,837,755 | B2 | 9/2014 | Jiles | |
| 9,137,605 | B2 | 9/2015 | Manley | |
| 9,137,610 | B2 | 9/2015 | Jiles | |
| 2002/0003890 | A1 | 1/2002 | Warren | |
| 2007/0036378 | A1 | 2/2007 | Saltykov | |
| 2009/0147983 | A1 | 6/2009 | Jiles | |
| 2015/0086049 | A1 | 3/2015 | Jiles | |
| 2015/0110338 | A1 | 4/2015 | McCratic | |
| 2015/0373456 | A1 | 12/2015 | Dayton | |

FOREIGN PATENT DOCUMENTS

| | | |
|---|---|---|
| CN | 203840179 | 9/2014 |
| CN | 203872027 | 10/2014 |
| CN | 203933199 | 11/2014 |
| CN | 203951282 | 11/2014 |
| CN | 203951286 | 11/2014 |
| CN | 203951601 | 11/2014 |
| CN | 204046390 | 12/2014 |
| CN | 204046391 | 12/2014 |
| CN | 204118999 | 1/2015 |
| CN | 204119001 | 1/2015 |
| CN | 204168459 | 2/2015 |
| CN | 204291354 | 4/2015 |
| CN | 204350281 | 5/2015 |
| CN | 204350282 | 5/2015 |
| CN | 204350283 | 5/2015 |
| CN | 204350284 | 5/2015 |
| CN | 204350285 | 5/2015 |
| CN | 204350286 | 5/2015 |
| CN | 105050010 | 11/2015 |
| EP | 0784415 B1 | 5/2002 |
| EP | 1247427 | 11/2003 |
| JP | 2007074499 A | 3/2007 |
| JP | 4876293 | 2/2012 |

* cited by examiner

SHOCK RESISTANT COIL AND RECEIVER

CROSS REFERENCE TO RELATED APPLICATIONS

This patent claims benefit under 35 U.S.C. §119 (e) to U.S. Provisional Application No. 61/892,112 entitled "Shock Resistant Coil and Receiver" filed Oct. 17, 2013, and Application No. 61/945,968 entitled "Shock Resistant Coil and Receiver" filed Feb. 28, 2014, the contents of both of which are incorporated herein by reference in their entireties.

TECHNICAL FIELD

This disclosure relates to acoustic devices and, more specifically, to shock absorption aspects of these devices.

BACKGROUND

Various types of microphones and receivers have been used through the years. In these devices, different electrical components are housed together within a housing or assembly. Other types of acoustic devices may include other types of components. These devices may be used in hearing instruments such as hearing aids or in other electronic devices such as cellular phones and computers.

The receiver motor typically includes a coil, a yoke, an armature (or reed), and magnets. An electrical signal applied to the coil creates a magnetic field within the motor which causes the armature to move. Movement of the armature causes movement of a diaphragm, which creates sound. Together, the magnets, armature, and yoke form a magnetic circuit. The yoke may also serve to hold or support the magnets or other components.

As mentioned, receivers are utilized in various types of applications. In many of these applications, the equipment that houses the receiver can be shaken, dropped, or otherwise receive potentially damaging mechanical shocks or forces. Without measures to absorb the shocks, the components of the receiver can be come damaged. If the receiver components become damaged, then the receiver potentially will not operate properly. Although there have been previous attempts at providing receivers that can handle shocks or other mechanical forces, these previous attempts have often used complicated procedures or additional structure that was costly to install. Consequently, there has been some user dissatisfaction with previous approaches.

BRIEF DESCRIPTION OF THE DRAWINGS

For a more complete understanding of the disclosure, reference should be made to the following detailed description and accompanying drawings wherein.

Figure 1:
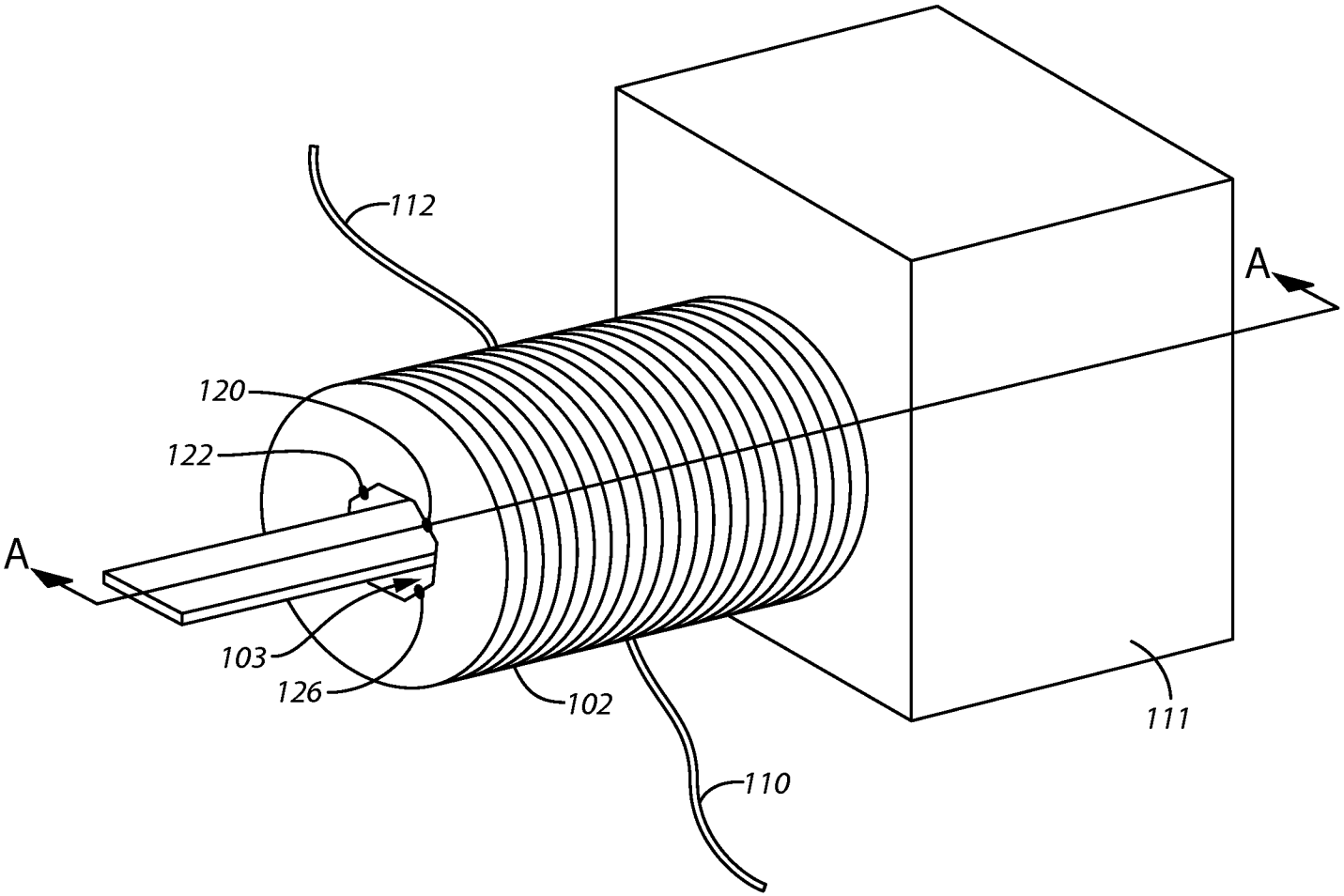
FIG. 1 is a perspective view of a receiver.
Figure 2:
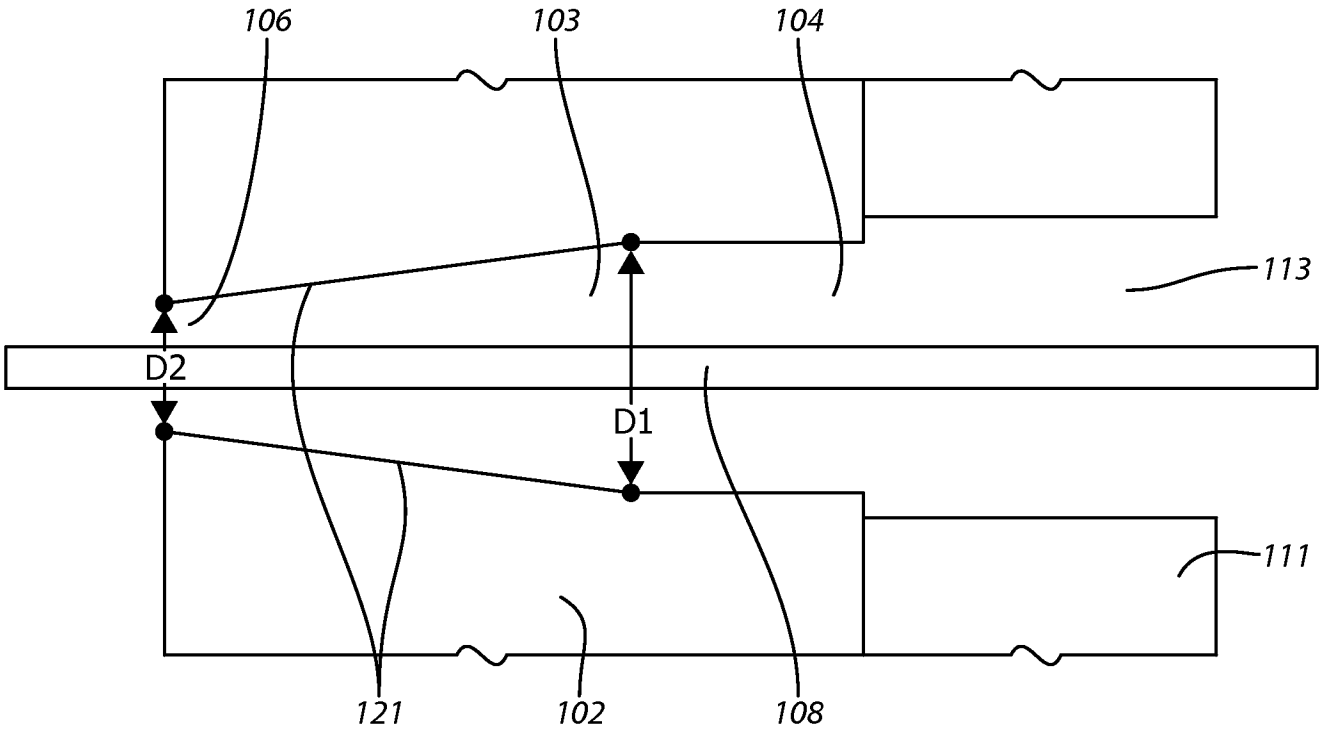
FIG. 2 is a side cut away view of the receiver of FIG. 1 taken along line A-A.

Those of ordinary skill in the art will appreciate that elements in the figures are illustrated for simplicity and clarity. It will be appreciated further that certain actions and/or steps may be described or depicted in a particular order of occurrence while those of ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The approaches described herein provide elongated coils (e.g., that have tunnels and a corresponding coil structure that are of an octagon shape or of a diamond shape) that provide shock protection for an armature. In this respect, as the armature moves in the tunnel it will contact the coil at two points rather than at a single point of contact. One advantage of the present approaches is that wire selection and/or the shape of the coil/tunnel is used to achieve shock protection without the need of an epoxy modem or other additional external devices.

Referring now to FIGS. 1, 2, 3A-C, 4A-C, one example of a receiver apparatus 100 that includes an elongated coil 102 is described. The coil 102 is formed with a coil tunnel 103 that extends from a first side 104 to a second side 106 of the coil 102. A reed (also referred to an armature herein) 108 extends through the coil tunnel 103. A first wire 110 and a second wire 112 are coupled to the coil. The first wire 110 and the second wire 112 provide a path for electrical excitation signals and current to enter the coil 102.

The coil tunnel 103 tapers from the first side 104 to the second side 106. The coil tunnel 103 is generally octagonal in shape (looking into the tunnel from the side of the coil 102) corresponding to the same shape by which the interior structure of the coil 102 (i.e., the structure adjacent to the coil tunnel 103). It will be understood that if the reed 108 moves too far, the reed 108 will contact the coil 102 at points 120, 122, 124, and 126 on the coil 102. In other words, when there is a shock (or other force) applied to the reed 108, the reed 108 will contact the coil 102 (which is the shock absorber) at two of the four points (points 120 and 122, or points 124 and 126) and not over a larger area. Additionally, there are no epoxy bumps that are needed to act as the shock absorber. In other words, the geometry of the coil itself is used as the shock absorber without the need for using additional devices or materials (e.g., epoxy or glue bumps). It will also be understood that other shapes (e.g., hexagons and diamonds to mention two examples) can also be used to shape the coil.

The coil 102 is coupled to or is disposed in close proximity to a stack portion 111. The stack portion 111 includes a stack tunnel 113 through which the reed 108 extends. As mentioned, the reed 108 also extends through the coil tunnel 103. It will be appreciated that the reed 108 may be a u-shaped reed and, in some examples, may be a flat reed.

In operation, an electrical current is applied to the coil (via the wires 110 and 112) and this creates a magnetic flux. The creation of the magnetic flux moves the armature 108 which in turn moves a rod (not shown). The rod is attached to a diaphragm (not shown) and movement of the rod causes movement of the diaphragm, which creates sound. The sound may be presented to a listener via a sound tube (in one example).

In operation, shocks and other unwanted forces might impact the coil 102. For example, the receiver (in which the coil is located) may itself be located in another device (e.g., a personal computer or cellular phone) and this device may be dropped producing an unwanted and potentially damaging force that impacts the coil 102. However, this shock or force is absorbed or dissipated by the coil 102 as has been generally described above.

Figure 3A:
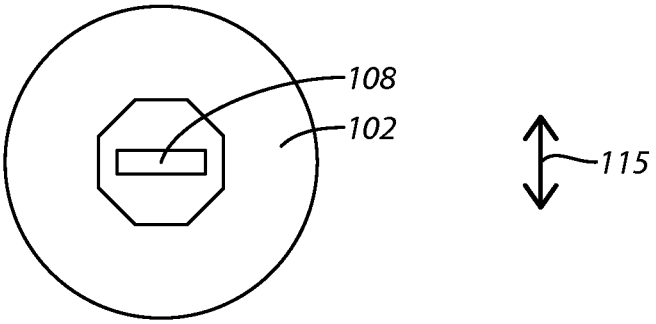
FIGS. 3A, 3B, and 3C are end views of the receivers of FIG. 1 and FIG. 2 showing one shape for the coil and coil tunnel.
Figure 3B:
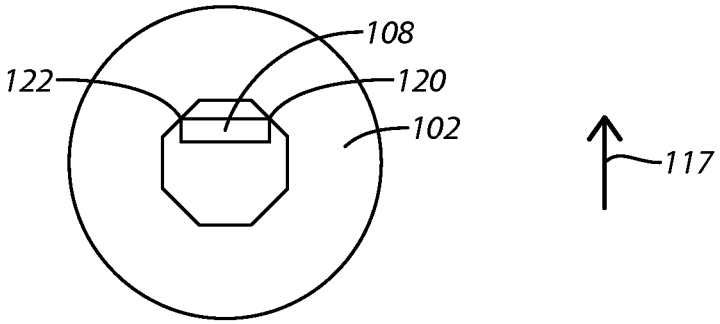
Figure 3C:
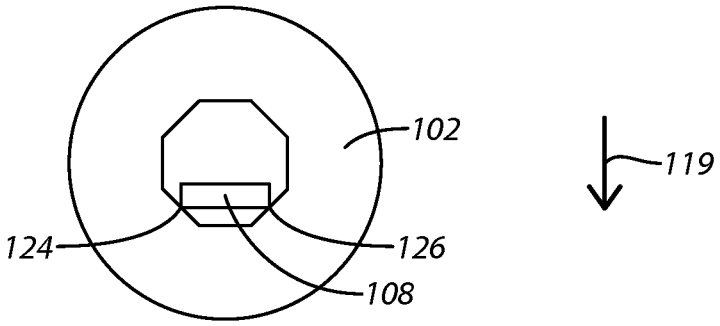

Referring now especially to FIGS. 3A, 3B, and 3C, a more detailed description of the shock absorption approaches presented herein is described. As shown in FIG. 3A, the placement of the reed 108 is shown where the reed 108 is generally disposed in the middle of the coil tunnel 103. The reed 108 may move in the direction indicated by the arrow 115. The reed 108 (in FIG. 3A) has not moved far enough to be in contact with any of the contact points 120, 122, 124, or 126.

As shown in FIG. 3B, the placement of the reed 108 is shown where the reed 108 moves upward in the direction indicated by the arrow labeled 117. The amount of movement by the reed 108 indicated by the arrow labeled 117 is sufficient so that the reed 108 comes into contact with contact points 120 and 122 of the coil 102. The reed 108 comes into contact at two points because the coil tunnel 103 is tapered presenting a face where the two points 120 and 122 are located.

As shown in FIG. 3C, the placement of the reed 108 is shown where the reed 108 moves downward in the direction indicated by the arrow labeled 119. The amount of movement by the reed 108 is sufficient so that the reed 108 comes into contact with contact points 124 and 126. The reed 108 comes into contact at two points because the coil tunnel 103 is tapered presenting a face where the two points 124 and 126 are located. Thus, the reed 108 does not impact a set of points (or region).

Figure 4A:
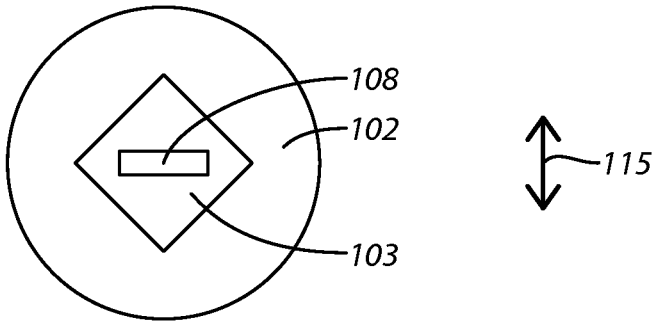
FIGS. 4A, 4B, and 4C are end views of the receivers of FIG. 1 and FIG. 2 showing another shape for the coil and coil tunnel.
Figure 4B:
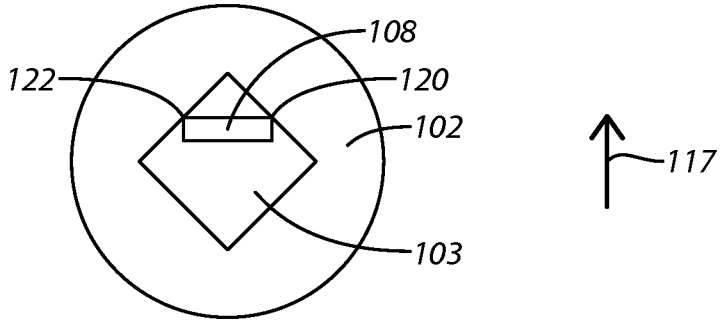
Figure 4C:
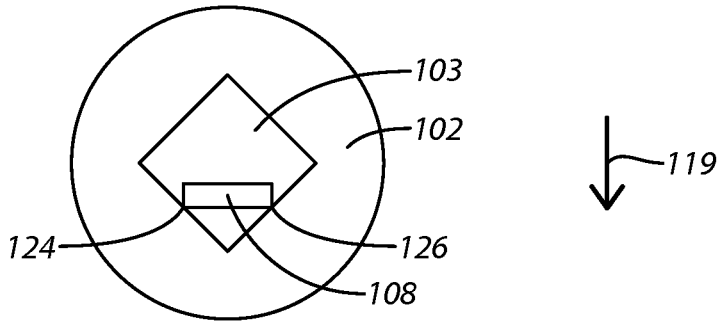

Referring now especially to FIGS. 4A, 4B, and 4C, a different configuration of the coil 102 is shown. In this case, a diamond-shaped configuration for the coil 102 and coil tunnel 103 is used.

As shown in FIG. 4A, the placement of the reed 108 is shown where the reed 108 is generally disposed in the middle of the tunnel 103 and does not move far enough to impact the coil 102. It may move in the direction indicated by the arrow 115. As mentioned, the reed 108 has not moved far enough to be in contact with any of the contact points 120, 122, 124, or 126.

As shown in FIG. 4B, the placement of the reed 108 is shown where the reed 108 moves upward in the direction indicated by the arrow labeled 117. The amount of movement by the reed 108 is sufficient so that the reed 108 comes into contact with contact points 120 and 122. The reed 108 comes into contact at two points because the coil tunnel 103 is tapered presenting a face where the two points 120 and 122 are located.

As shown in FIG. 4C, the placement of the reed 108 is shown where the reed 108 moves downward in the direction indicated by the arrow labeled 119. The amount of movement by the reed 108 is sufficient so that the reed 108 comes into contact with contact points 124 and 126. The reed 108 comes into contact at two points because the coil tunnel 103 is tapered presenting a face where the two points 124 and 126 are located.

Figure 5:
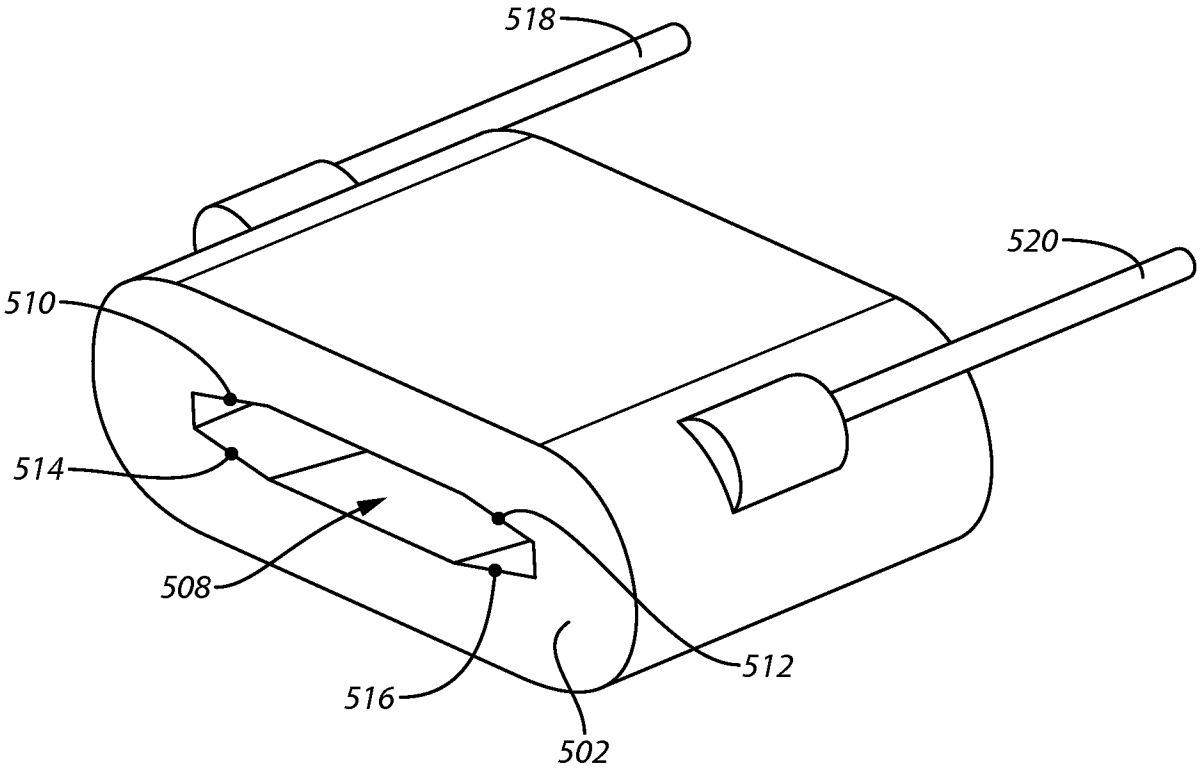
FIG. 5 are a perspective view of a coil.
Figure 6:
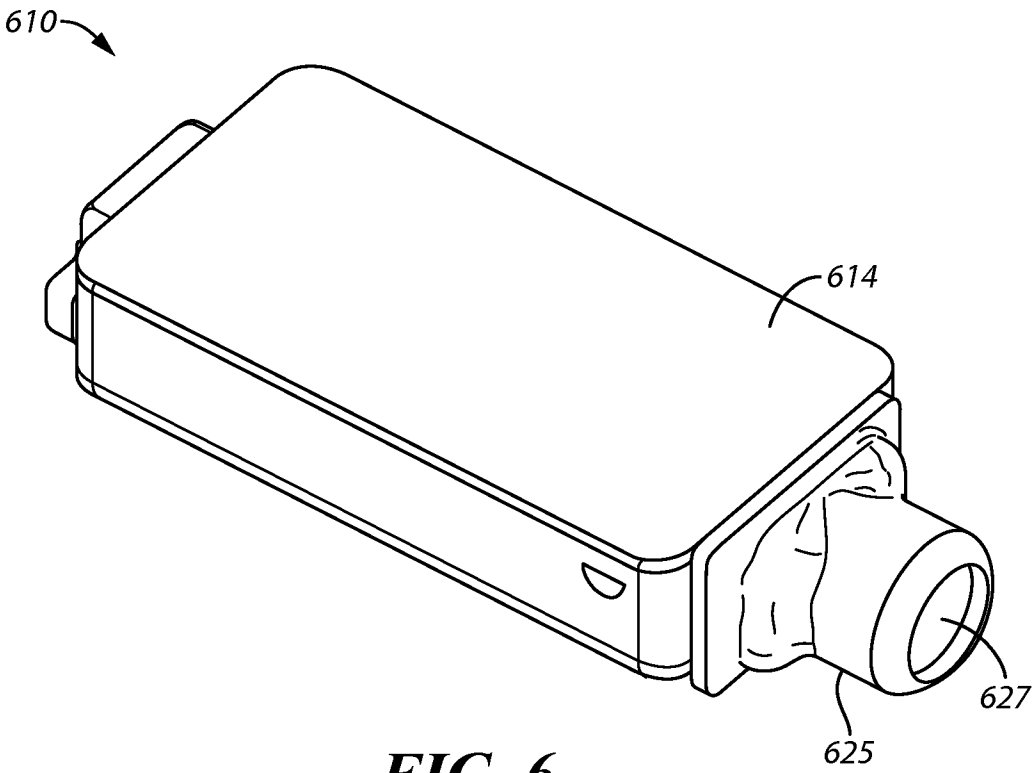
FIG. 6 is a perspective view of a receiver.
Figure 7:
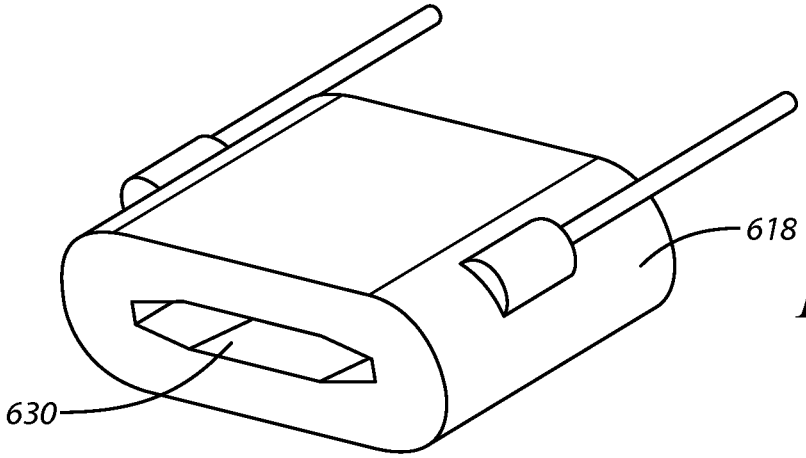
FIG. 7 is a perspective view of a coil.
Figure 8:
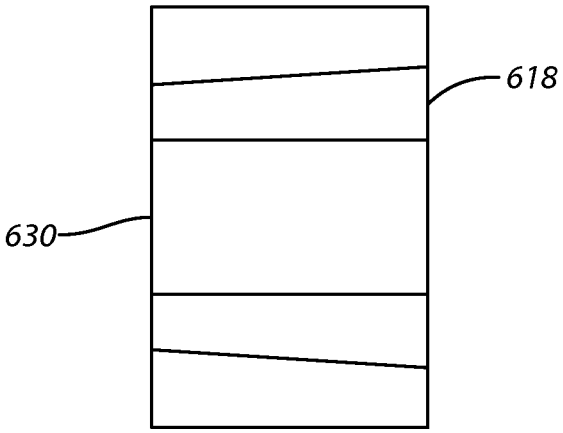
FIG. 8 is a top cutaway view of the coil of FIG. 7.
Figure 9:
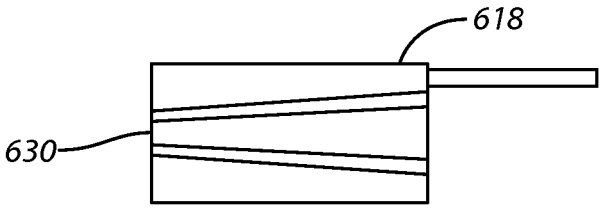
FIG. 9 is a side cutaway section view of the coil of FIG. 7 and FIG. 8.
Figure 10:
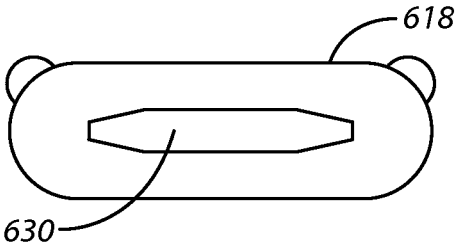
FIG. 10 is a front view of the coil of FIGS. 7-9.
Figure 11:
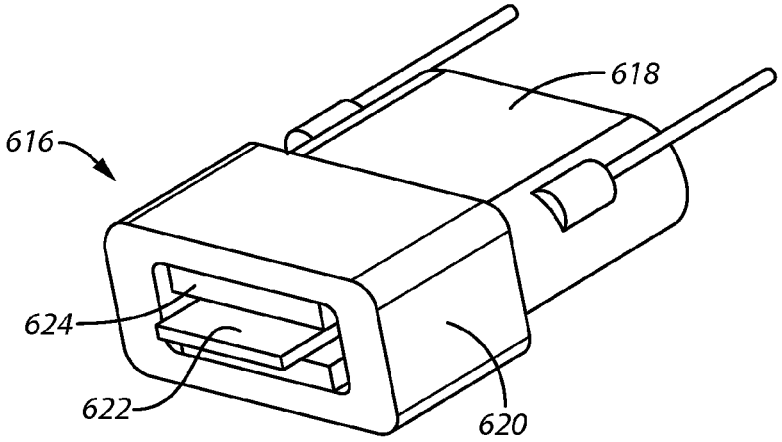
FIG. 11 is a perspective view of a motor including the coil of FIGS. 7-10.
Figure 12:
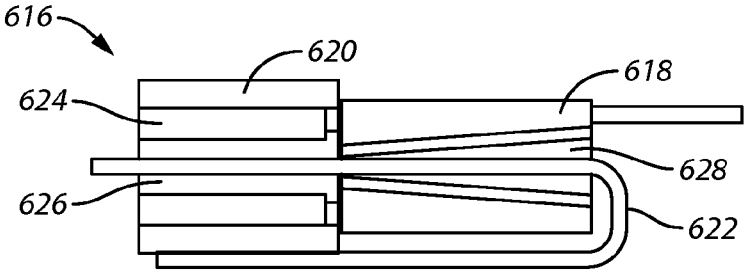
FIG. 12 is a side cutaway section view of the motor of FIG. 11.
Figure 13:
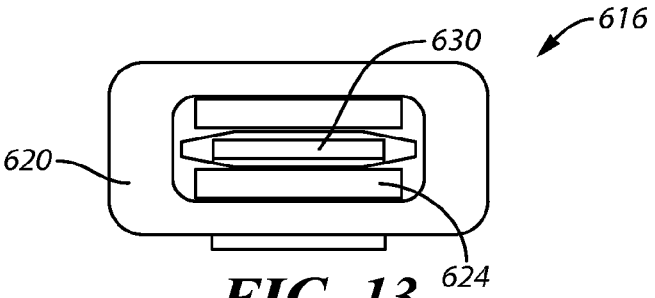
FIG. 13 is a front view of the motor of FIG. 11 and FIG. 12.

Referring now to FIG. 5, one example of a coil (without the stack or other elements of the receiver) is described. As shown, a coil 502 includes an opening 508 through which an armature (not shown) extends. The opening 508 in the coil 502 is generally octagonal in shape. As the armature moves it will come into contact points 510 and 512 (if it moves up) or 514 or 516 if it moves down. Wires 518 and 520 connect the coil to a current source. The other aspects of the coil of FIG. 5 have already been described above with respect to the coil 102 and will not be repeated here.

It will be appreciated that the coils and receivers provided herein may be constructed according to a variety of different processes and approaches. For instance, the coils can be manufactured using both a dry or wet wind process. By a dry wind process it is meant that the coils are bonded and layered together by the use of induction, convection, and or conductive heating of the thermoset wire. By a wet wind process, it is meant that the coils are constructed by using epoxies, glues, and any other fluid, gel, or paste used as a binding agent. Generally speaking, a dry wind process is more controllable, less costly, and more repeatable.

The approaches described herein provide elongated coils (e.g., that have tunnels and a corresponding coil structure that are of an octagon shape or of a diamond shape) that provide shock protection for an armature. In this respect, as the armature moves in the tunnel it will contact the coil at two points rather than at a single point of contact. One advantage of the present approaches is that wire selection and/or the shape of the coil/tunnel is used to achieve shock protection without the need of a molded epoxy or other additional external devices.

In operation, shocks are other unwanted forces might impact the coils. For example, the receiver (in which the coil is located) may itself be located in another device (e.g., a personal computer or cellular phone) and this device may be dropped producing an unwanted and potentially damaging force that impacts the coil. However, this shock or force is absorbed or dissipated by the coil as has been generally described above.

Approaches are described herein that provide receivers that can be used in various applications such as hearing instruments (HIs). The receivers described herein can also be deployed in other devices such as personal computers and cellular phones. Other examples of devices are possible.

Referring now to FIGS. 6-16, examples of a receiver 610 are described. The receiver comprises a housing 614 defining an interior and an exterior. The receiver 610 further comprises a motor 616 including a coil 618, a stack (or magnetic support structure) 620, and an armature 622 disposed substantially within the housing 614. Electric currents representing the sounds to be produced are moved through the coil 618. Current through the coil 618 displaces armature 622, which in turn displaces a drive pin, causing a diaphragm to vibrate and create the desired sound. Sound exits through a port in the housing and then through a sound tube 625.

As mentioned, the motor 616 includes the armature 622, the coil 618, and the magnetic support structure 620. The motor 616 also includes at least one magnet 624 that defines a space 626. The coil 618 forms a tunnel 628. The space 626 is defined by the at least one magnet 624 being aligned with the tunnel 628 formed by the coil 618. Portions of the armature 622 extend through the space 626 and the tunnel 628. An opening 630 at an end of the coil 618 is shaped so as to restrict movement of the armature.

Figure 14:
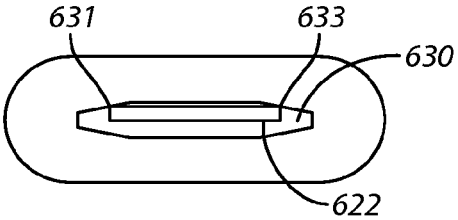
FIG. 14 is a front view of the motor of FIGS. 11-13 with the armature deflected in one direction.
Figure 15:
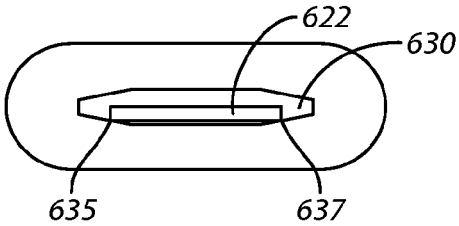
FIG. 15 is a front view of the motor of FIGS. 11-13 with the armature deflected in a second direction.

Referring now especially to FIG. 14 and FIG. 15, FIG. 14 shows an opening that has an octagonal shape with the armature deflecting upward and touching the coil 618 at points 631 and 633 at the opening. FIG. 15 shows an opening that has an octagonal shape with the armature deflecting downward and touching the coil 618 at points 635 and 637 at the opening.

In one aspect, portions of the coil 618 are tapered from a first width at a first end of the tunnel 628, to a second width at a second end of the tunnel 628. In another aspect, the opening 630 is shaped as an octagon. In yet another aspect, the opening 630 is shaped as a diamond.

Figure 16A:
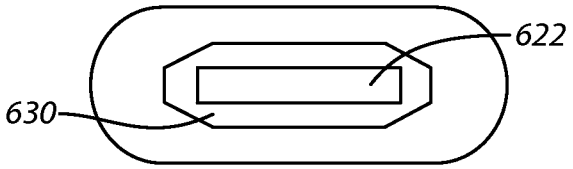
FIGS. 16A-F are front views of coils.
Figure 16B:
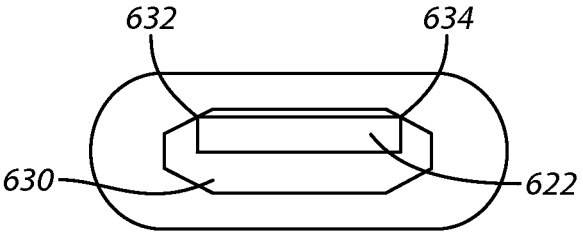
Figure 16C:
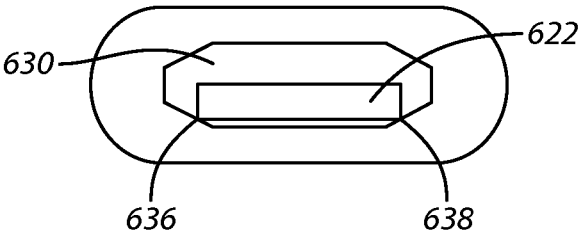

Referring now to FIGS. 16A-16F, various shapes for the end portion of the coil are described. FIG. 16A shows an opening that has an octagonal shape with the armature in the middle and not touching the coil 618. FIG. 16B shows an opening that has an octagonal shape with the armature deflecting upward and touching the coil 618 at points 632 and 634 at the opening. FIG. 16C shows an opening that has an octagonal shape with the armature deflecting downward and touching the coil 618 at points 636 and 638 at the opening.

Figure 16D:
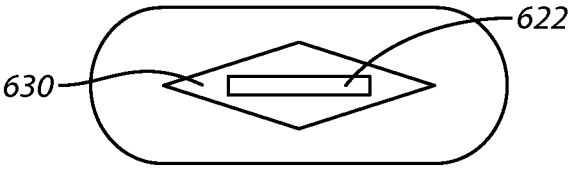
Figure 16E:
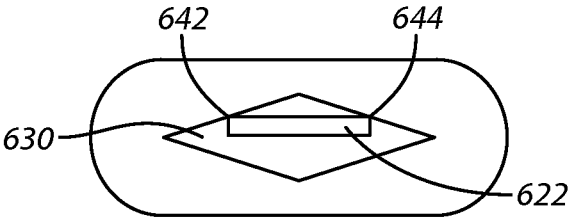
Figure 16F:
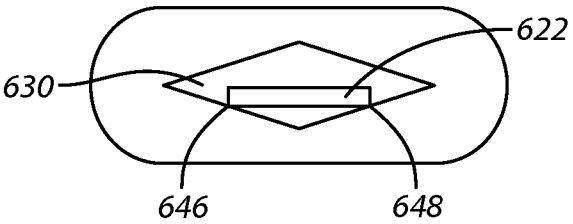

FIG. 16D shows an opening that has a diamond shape with the armature in the middle and not touching the coil 618. FIG. 16E shows an opening that has a diamond shape with the armature deflecting upward and touching the coil 618 at points 642 and 644 at the opening. FIG. 16F shows an opening that has a diamond shape with the armature deflecting downward and touching the coil 618 at points 646 and 648 at the opening.

In other examples, portions of the coil 618 are tapered and the portions are a first side portion and a second side portion of the tunnel 628. In other examples, portions of the coil 618 are tapered and the portions are a top portion and a bottom portion of the tunnel 28, and a first side portion and a second side portion of the tunnel 628.

It will be appreciated that the coils and receivers provided herein may be constructed according to a variety of different processes and approaches. For instance, the coils can be manufactured using both a wet and dry wind process. By a dry wind process it is meant that the coils are bonded and layered together by the use of induction, convection, and or conductive heating of the thermoset wire. By a wet wind process, it is meant that the coils are constructed by using epoxies, glues, and any other fluid, gel, or paste used as a binding agent. Generally speaking, a dry wind process is more controllable, less costly, and more repeatable.

Preferred embodiments of the disclosure are described herein, including the best mode known to the inventor(s). It should be understood that the illustrated embodiments are exemplary only, and should not be taken as limiting the scope of the appended claims.

What is claimed is:

1. A motor for an acoustic device, the motor comprising:

an armature;

at least one magnet;

a coil; and a magnetic support structure;

wherein the at least one magnet defines a space, wherein the coil forms a tunnel, and wherein the space defined by the at least one magnet is aligned with the tunnel formed by the coil;

wherein portions of the armature extend through the space and the tunnel, wherein an opening at an end of the coil is shaped so as to restrict movement of the armature;

wherein the armature moves in an upward vertical direction and a downward vertical direction;

wherein portions of the tunnel are tapered and the opening is shaped as an octagon or a diamond such that when the armature moves in the upward vertical direction, the armature contacts the opening only at a first contact point and a second contact point, and such that when the armature moves in the downward vertical direction the armature contacts the opening at a third contact point and a fourth contact point, wherein the first contact point, the second contact point, the third contact point, and the fourth contact point are separate and distinct from each other.

2. The motor of claim 1, wherein portions of the coil are tapered from a first width at a first end of the tunnel, to a second width at a second end of the tunnel.

3. The motor of claim 1, wherein the portions of the tunnel are a first side portion and a second side portion of the tunnel.

4. The motor of claim 1, wherein the portions of the tunnel are a top portion and a bottom portion of the tunnel, and a first side portion and a second side portion of the tunnel.

5. A hearing instrument receiver comprising:

a motor including a coil having a coil passage extending through the coil, the motor including an armature, a portion of the armature extending into the coil passage, the armature free to deflect within the coil passage in response to an excitation signal applied to the coil, at least a portion of the coil passage having a narrowing taper defining a narrow-most cross-sectional dimension of the coil passage through which the armature extends, wherein the armature contacts the coil at a first discrete contact point of the narrow-most cross-sectional dimension of the coil passage upon over-deflection of the armature in a first direction and the armature contacts the coil at a second discrete contact point of the narrow-most cross-sectional dimension of the coil passage upon over-deflection of the armature in a second direction opposite the first direction; and a diaphragm coupled to the armature.

6. The receiver of claim 5, the coil passage having a quasi-polygonal cross-section at the narrow-most cross-sectional dimension of the coil passage, wherein the armature contacts the coil at multiple discrete contact points of the narrow-most cross-sectional dimension of the coil passage upon over-deflection of the armature in the first direction and the armature contacts the coil at multiple discrete contact points of the narrow-most cross-sectional dimension of the coil passage upon over-deflection of the armature in the second direction.

7. The receiver of claim 6, the armature has a generally polygonal cross-section in at least a region where the armature extends through the narrow-most cross-sectional dimension of the coil passage, lateral edges of a first side of the armature contacting corresponding discrete contact points of the narrow-most cross-sectional dimension of the coil passage upon over-deflection of the armature in the first and second directions, and lateral edges on a second side of the armature, opposite the first side thereof, contacting corresponding discrete contact points of the narrow-most cross-sectional dimension of the coil passage upon over-deflection of the armature in the first and second directions.

8. The receiver of claim 6, the coil has a generally octagonal cross-section at the narrow-most cross-sectional dimension of the coil passage.

9. The receiver of claim 6, the coil has a generally hexagonal cross-section at the narrow-most cross-sectional dimension of the coil passage.

10. The receiver of claim 6, the coil has a first end and an opposite second end between which the coil passage extends, the narrow-most cross-sectional dimension of the coil passage corresponds to the first end of the coil.

11. The receiver of claim 10, the motor including a yoke having magnetic material and a yoke passage extending through the yoke, the yoke passage aligned with the coil passage, a portion of the armature extending into the yoke passage adjacent the magnetic material, the armature free to deflect within the yoke passage in response to an excitation signal applied to the coil.

12. The receiver of claim 6 further comprising a housing having a sound port, the motor and the diaphragm disposed within the housing, the diaphragm in acoustic communication with the sound port.

13. The receiver of claim 6 further comprising a yoke having a yoke passage, the yoke passage aligned with the coil passage, two magnets disposed within the yoke passage, a portion of the armature extending into the yoke passage between the two magnets, the armature free to deflect between the two magnets in response to an excitation signal applied to the coil, wherein the coil prevents contact between the armature and the two magnets upon over-deflection of the armature.

14. A motor for an acoustic device, the motor comprising:

a coil assembly including a coil, a coil passage extending through the coil assembly between opposite ends of the coil assembly, an armature having a portion extending into the coil passage, the armature free to deflect within the coil passage in response to an excitation signal applied to the coil, at least a portion of the coil passage having a narrowing taper defining a narrow-most cross-sectional dimension of the coil passage at one end of the coil assembly, wherein the armature contacts the coil at a first discrete contact point of the narrow-most cross-sectional dimension of the coil passage upon over-deflection of the armature in a first direction and the armature contacts the coil at a second discrete contact point of the narrow-most cross-sectional dimension of the coil passage upon over-deflection of the armature in a second direction opposite the first direction; and a diaphragm coupled to the armature.

15. The device of claim 14, the coil passage having a quasi-polygonal cross-section at the narrow-most cross-sectional dimension of the coil passage, wherein the armature contacts the coil at a multiple discrete contact points of the narrow-most cross-sectional dimension of the coil passage upon over-deflection of the armature in the first direction and the armature contacts the coil at multiple discrete contact points of the narrow-most cross-sectional dimension of the coil passage upon over-deflection of the armature in the second direction.

16. The device of claim 14 further comprising a yoke having a yoke passage and two magnets disposed within the yoke passage, the yoke passage aligned with the coil passage, a portion of the armature extending into the yoke passage between the two magnets, the armature free to deflect between the two magnets in response to an excitation signal applied to the coil.

17. The device of claim 16 further comprising a housing having a sound port, wherein the coil assembly, the armature and the diaphragm are disposed within the housing.

18. The device of claim 16, the coil prevents contact between the armature and the two magnets upon over-deflection of the armature.

* * * * *